United States Patent [19]

Sammon

[11] Patent Number: 5,077,773

[45] Date of Patent: Dec. 31, 1991

[54] AUTOMATIC FILAMENT CALIBRATION SYSTEM FOR X-RAY GENERATORS

[75] Inventor: Robert J. Sammon, Seven Hills, Ohio

[73] Assignee: Picker International, Inc., Highland Hts., Ohio

[21] Appl. No.: 549,404

[22] Filed: Jul. 5, 1990

[51] Int. Cl.[5] ..... H05G 1/34; H05G 1/50

[52] U.S. Cl. ..... 378/110; 378/207; 378/109; 378/113; 378/118

[58] Field of Search ..... 378/110, 112, 109, 108, 378/111, 113, 117, 118, 207

[56] References Cited

U.S. PATENT DOCUMENTS 4,593,371 6/1986 Grajewski ..... 378/108

*Primary Examiner*—Edward P. Westin
*Assistant Examiner*—Don Wong
*Attorney, Agent, or Firm*—Fay, Sharpe, Beall, Fagan, Minnich & McKee

[57] ABSTRACT

A voltage control (22) controls the voltage applied between an anode (12) and a cathode filament (14) of an x-ray tube (10). A filament control (16) controls the amount of current fed through the filament. A voltage controlled oscillator (40) and counter (42) monitor the magnitude, if any, of a tube current (24) flowing between the cathode and the anode to generate x-rays (26). A microprocessor (50) calibrates the filament current such that the filament current value stored in a filament current look-up table (122) for each selectable tube voltage and tube current combination actually produces the selected tube current. The filament current is initialized (60) to a small current value and progressively incremented (66) until a commencement of the tube current (24) is monitored (64). To calibrate each selectable tube voltage, tube current combination, the filament current is incremented from this initial current flow or emission point (52) and the resultant tube current is compared (98) with the selected tube current. A substantial portion of the filament current values stored in the filament current look-up table are determined this way and the rest are determined by interpolation (140).

15 Claims, 4 Drawing Sheets

10
12
14
16
20
22
24
26
28
30
32
34
36+
36-
40
42
44
50
120
122
128
140
142
kV
mA
kV, mA
$I_{fil}$
μproc
$I_{fil}$ CONTROL
COUNTER
VCO
kV CONTROL
OPERATOR CONTROL KEYBOARD
INTERPOLATE

AUTOMATIC FILAMENT CALIBRATION SYSTEM FOR X-RAY GENERATORS

BACKGROUND OF THE INVENTION

The present invention relates to the automatic calibration arts. It finds particular application in conjunction with the automatic calibration of x-ray tubes and will be described with particular reference thereto.

Each model and type of x-ray tube conventionally has a published set of filament emission curves or tables. These curve sets or tables commonly take the form of a graph of filament current vs. tube current or mA for each of a plurality of fixed tube voltages or kV. For example, the curve set might include curves for each of three or four tube voltages between 50 kV and 150 kV.

In an x-ray device, the x-ray tube is commonly operated for a selected duration at a selected tube current and voltage combination. This generates a corresponding amount of x-rays of the appropriate energy to penetrate the patient or subject and properly expose photographic film or provide appropriate x-ray flux for other x-ray detection equipment. Generally, the tube voltage across the anode and cathode is readily set. The tube current is controlled by adjusting the current flowing through the cathode filament. Increasing the filament current increases electron emission from the cathode which increases the tube current or electron flow between the cathode and anode. By referring to the filament emission curve set, the filament current required to produce a selected tube current at a selected tube voltage is readily determined.

Heretofore, x-ray equipment has been calibrated with data taken from the filament emission curves. Most commonly, the filament emission curves were used to set the filament current that would be supplied for each combination of x-ray tube currents and voltages that could be selected. To be sure that these were accurate, an initial calibration process was frequently conducted. Either manually or automatically, exposures were taken with each of a plurality of the selected x-ray tube current and voltage parameters. The actual tube current produced was compared with the selected tube current. When the actual and selected tube currents differed, the filament current was adjusted down or up from the value read from the curves as necessary to being the actual and selected tube currents together.

One of the problems with this prior art calibration technique is that it could damage the x-ray tube filament. The filament has a low impedance and operates at a high current. Filament temperature varies generally with power across it, i.e. $I^2R$ where I is the filament current and R is the filament resistance and filament current varies generally as V/R, where V is the voltage applied across the filament. Even normal manufacturing tolerances of this filament can cause a major change in its resistance, hence its operating temperature and the resultant tube current. For example, typical tolerances for the filament current on the curve table are on the order of $\pm 0.15$ amps. A variation of 0.15 filament amps can make a difference of plus or minus 300 to 400 mA in the tube current. Particularly when testing the high tube current values, the filament might produce up to 400 mA more than expected. This extra tube current increases the heating of the anode. A tube current increase of the 300 to 400 milliamp range can increase the anode temperature to the melting point or other thermal damage.

The present invention contemplates a new and improved calibration procedure which does not risk damaging the x-ray tube anode.

SUMMARY OF THE INVENTION

The present invention contemplates a new and improved x-ray tube calibration technique which calibrates x-ray tube current (mA) without relying on a priori information, such as filament emission curves.

One of a plurality of preselected x-ray tube voltages is set across the x-ray tube, e.g. the highest. A gradually increasing current is fed through to the x-ray tube filament as the x-ray tube current is monitored. The filament current starts sufficiently small that the filament is not heated enough for an x-ray tube current to flow from the cathode to the anode. The filament current is gradually increased until electrons are drawn from the cathode to the anode, i.e. the x-ray tube emission point is determined.

Starting at the emission point, tube current and voltage combinations are selected, preferably the lowest tube current and highest tube voltage combination first. The filament current is increased from the emission point until the actual tube current matches the selected tube current. Thereafter, the next tube current voltage combination is set and the process repeated.

In accordance with a more limited aspect of the present invention, the filament current is adjusted in steps. In determining the emission current point, the filament current is increased in steps until the tube current starts. The current is then decremented by half a step. The tube current is then incremented, or decremented, as may be appropriate, with each step being half the preceding step to focus in on the emission point.

Analogously, the tube current is stepped starting at the emission point to the lowest tube current in steps until the selected lowest tube current is met or exceeded. Thereafter, the filament current is decremented and incremented, as may be appropriate, with each step being half the preceding step until the selected tube current to focus in on the selected tube current.

A primary advantage of the present invention is that it avoids thermally damaging the x-ray tube.

Another advantage of the present invention resides in approaching each calibration current from below which reduces tube current overshoot.

Another advantage of the present invention is that it quickly, in less than two minutes, automatically calibrates a full range of x-ray tube operating parameters.

Still further advantages will become apparent upon reading and understanding the following detailed description.

BRIEF DESCRIPTION OF THE DRAWINGS

The present invention may take form in various steps and arrangements of steps and in various components and arrangements of components. The drawings are only for purposes of illustrating a preferred embodiment and are not to be construed as limiting the invention.

DETAILED DESCRIPTION OF THE PREFERRED EMBODIMENT

Figure 1:
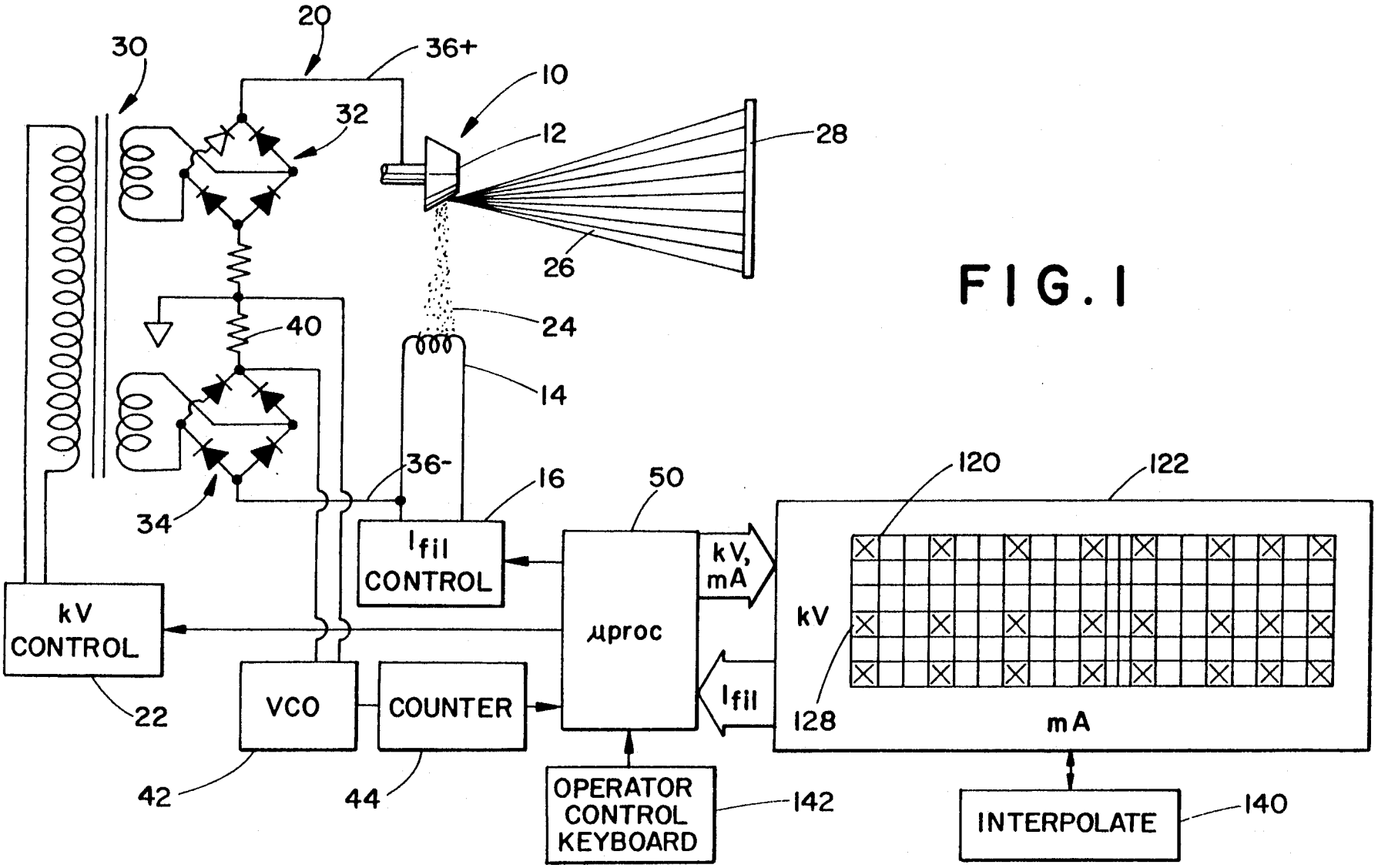
FIG. 1 is a diagrammatic illustration of an x-ray tube in combination with an automatic calibration and control circuit.

With reference to FIG. 1, an x-ray tube 10 has an anode 12 and a cathode filament 14. A filament current control means 16 provides a selectably adjustable current through the cathode filament 14 causing the filament to boil off an electrode cloud. A power supply 20 under the control of a kV or tube voltage control means 22 applies a selected voltage between the cathode filament 14 and the anode 12. The potential difference causes a tube current 24 as the boiled off electrons are attracted from the cathode filament 14 to the surface of the anode 12. The collision of this high energy electron beam and the anode cause a beam of x-rays 26 to be generated. However, the energy of the collision is so high that the anode heats to near its melting point. The x-rays traverse a patient receiving region and impinge on an x-ray sensitive medium 28, such as photographic film, solid state x-ray detectors, or the like. Optionally, the anode 12 may rotate such that the electron beam dwells a shorter duration at a given point on the anode surface to reduce heating and avoid thermal degradation.

The power supply 20 includes a high tension transformer 30 whose primary voltage is controlled by the tube voltage control 22. A pair of secondary windings are each connected across analogous rectifier bridges 32, 34 such that the selected tube voltage is created across output terminals +36 and −36.

Because the current flow through the x-ray tube is essentially a closed loop, the same current that flows between the cathode and the anode flows through a resistor 40 connecting the rectifier bridges. Accordingly, the x-ray current or mA can be sensed by sensing the voltage across the resistor 40. A voltage controlled oscillator 42 is connected across the resistor 40 such that it produces an output signal whose frequency or pulse rate varies in proportion to the voltage across resistor 40, hence the tube current 24. A counter means 44 counts the output pulses of the voltage controlled oscillator for a unit time to provide a numeric output indicative of the actual tube current.

Figure 2:
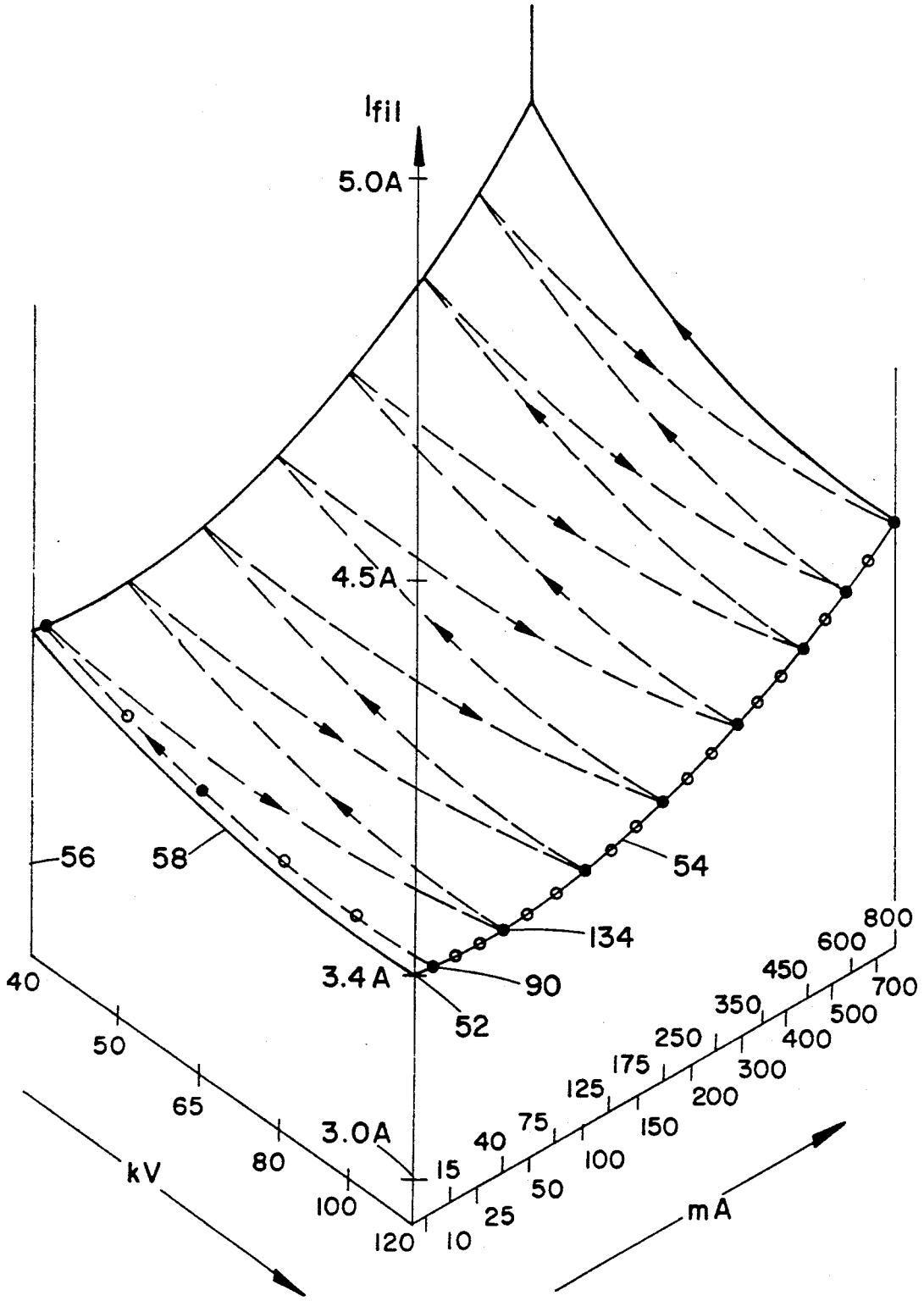
FIG. 2 is illustrative of an exemplary tube current (mA), tube voltage (kV), and filament current ($I_{fil}$) relationship.

With continuing reference to FIG. 1 and further reference to FIG. 2, a microprocessor control circuit 50 instructs the filament current control 16 and the tube voltage control 22 in accordance with the actual tube current as determined by the counter 42. At a selected tube voltage, generally the highest voltage rating, e.g. 120 kV, no tube current 24 flows when the filament current $I_{fil}$ is low, e.g. below 3.0 amps. As the filament increases, no tube current will flow until an emission point 52 is reached, e.g. around 3.4 amps. Thereafter, each small increase in the filament amperage causes the tube current to change generally along a fixed voltage, mA v $I_{fil}$ curve 54. As the tube voltage is decreased toward the minimum tube voltage 56, e.g. 40 kV, a progressively higher filament current becomes necessary to reach the emission point, as described by curve 58. In this manner, the tube voltage, tube current, and filament current relationship is defined by a generally warped surface.

Figure 3:
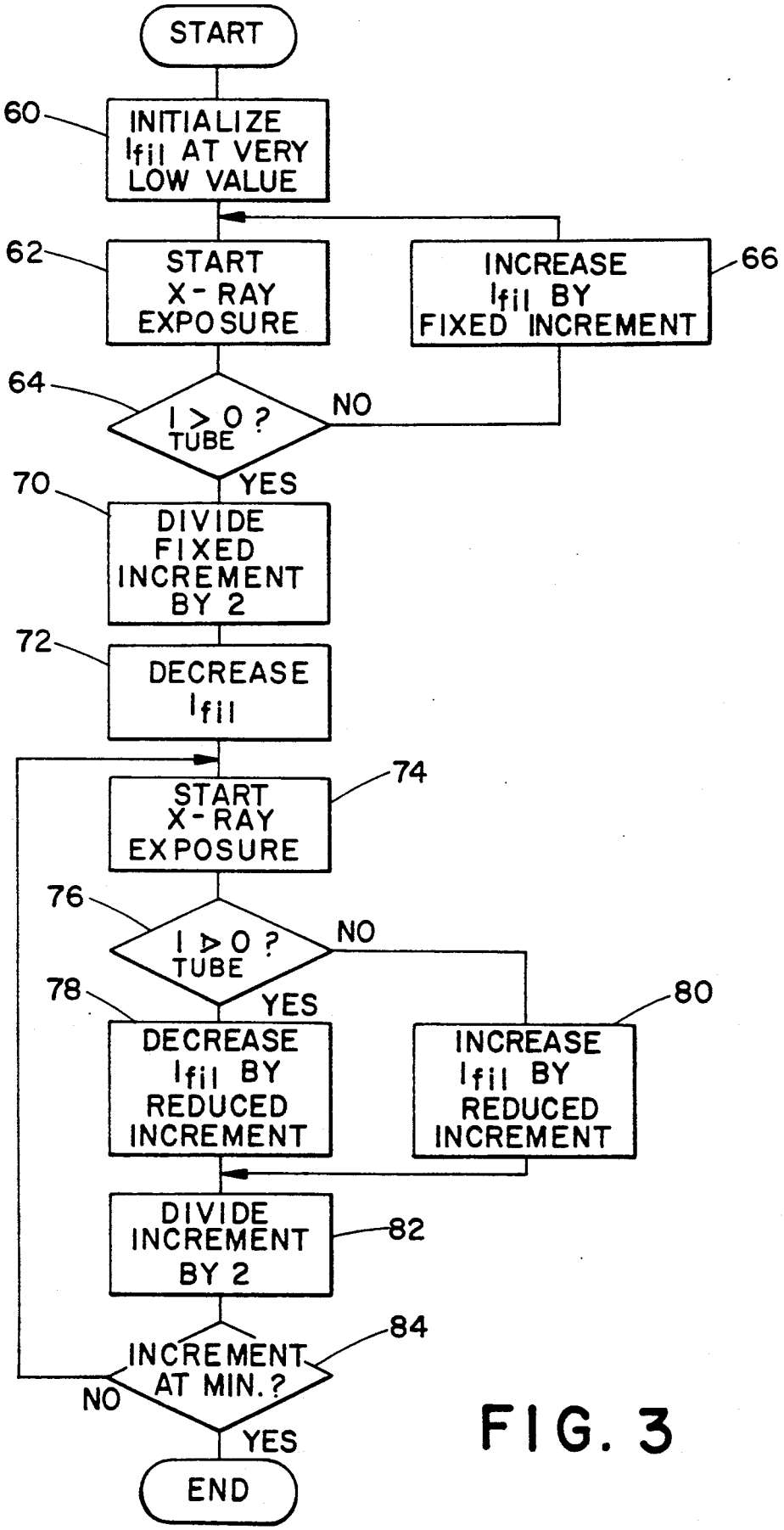
FIG. 3 is a flow chart illustrating the steps or means for identifying the emission point; and, FIG. 4 illustrates appropriate steps or means for determining the filament current calibration at each of a plurality of tube current and voltage settings.

With continuing reference to FIG. 2 and further reference to FIG. 3, the microprocessor 50 has a means or performs a step 60 for causing the filament current control means 16 to set the filament current to some initial low value, e.g. 3.0 amps. A means or step 62 causes the x-ray tube voltage control means 22 to apply the maximum selectable tube voltage across the cathode and anode to start an exposure. A tube current determining means or step 64 monitors the output of counters 44 to determine whether a tube current 24 is flowing. If there is no tube current flowing, a step or means 16 causes the filament current control means 66 to increase the filament current by a preselected step or increment. The tube voltage is applied again at 62 and a check is again made at 64 to determine whether the tube current has started to flow. This increment, expose, and check routine is continued cyclically until a tube current is sensed.

Once the tube current has started to flow, a step or means 70 divides the filament current increment by two to reduce the step or increment size. A step or means 72 causes the filament current control means 16 to decrease or decrement the filament current by the half size step. A step or means 74 causes the voltage control means 22 to start an another exposure so that a tube current monitoring step or means 76 can check whether the tube current still flows at this lower filament current. If the filament current is still flowing at this lower current, a filament current decreasing means or step 78 causes the filament current to be decreased by the smaller step and if the tube current is no longer flowing at this filament current, a filament current increasing means or step 80 causes the filament current to be increased by the half step. A step reducing means or step 82 divides the filament current step in half again. Optionally, step or means 82 may be disposed between steps or means 74 and 76. This process of adjusting the filament current, starting an exposure to see if a tube current flows, and dividing the filament step by two continues until a step or means 84 determines that a preselected minimum filament current step size has been reached. The filament current at this point is then designated as the filament current at the emission point.

Figure 4:
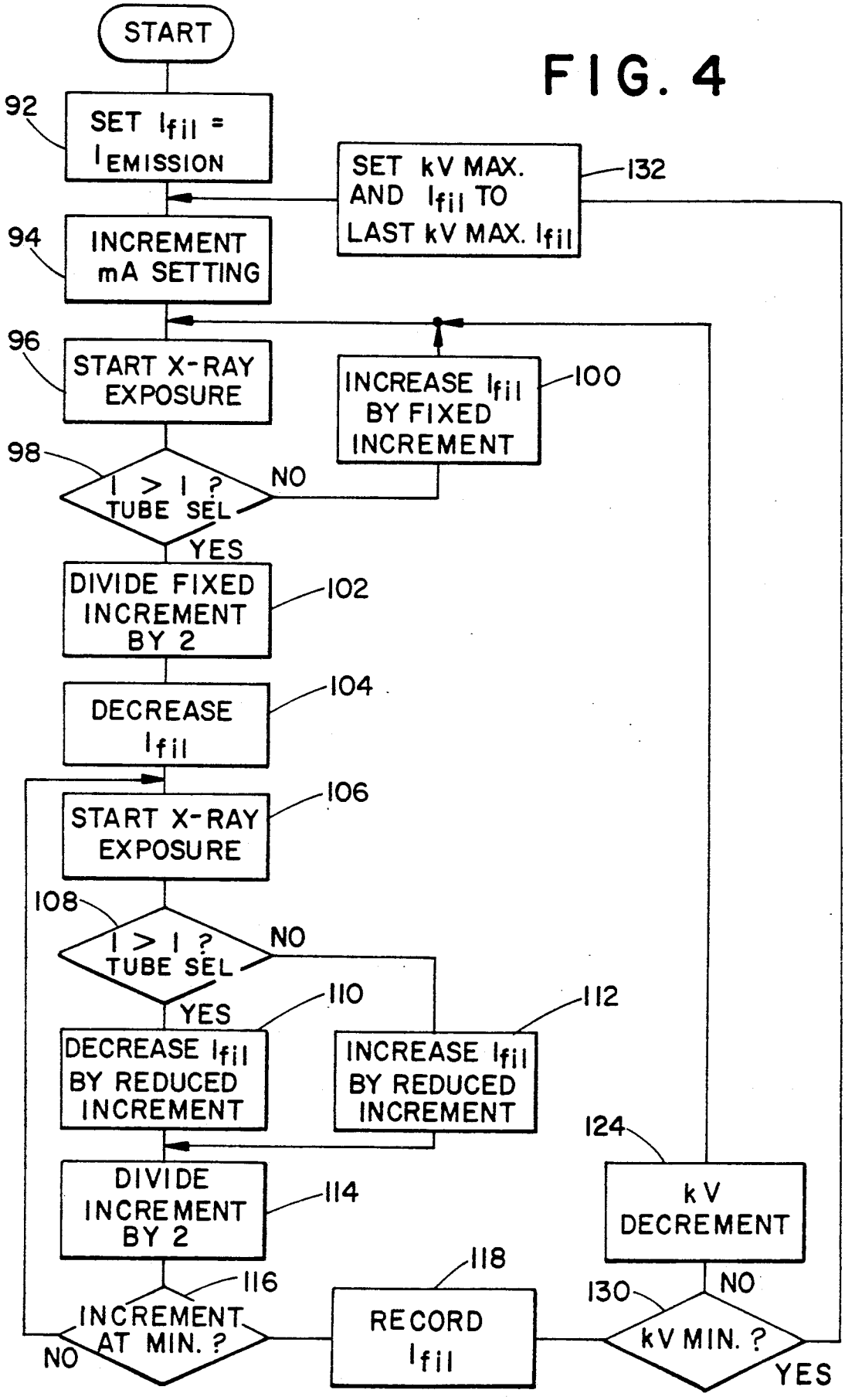

With reference to FIG. 4 and continuing reference to FIG. 2, once the emission point 52 is determined, the filament current which causes a first selected tube current 90 to be caused at maximum tube voltage is determined. A step or means 92 sets the filament current at the emission current level, i.e. at the filament current level which produces the smallest measurable tube current which is lower than the selected tube current 90. A Tube current incrementing means or step 94 sets a desired tube current value successively to each of a plurality of preselected values and resets the tube voltage to the maximum voltage. An x-ray exposure starting step or means 96 causes the tube voltage control means 22 to apply the tube voltage across the anode and cathode and a tube current detecting means or step 98 determines whether the tube current measured by the counter means 42 exceeds the tube current selected with a tube current selecting step or means 94. If the actual tube current is below the selected tube current, a filament current incrementing means 100 increments the filament current by a preselected filament current step and the exposure and comparing steps are repeated. This expose compare and increment procedure is repeated until the actually measured tube current exceeds the selected tube current.

Once the tube current exceeds the selected tube current, a step or means 102 divides the filament current increment by two to reduce the step or increment size. A step or means 104 causes the filament current control means 16 to decrease or decrement the filament current by the half size step. A step or means 106 causes the voltage control means 22 to start an another exposure so that a tube current monitoring step or means 108 can check whether the tube current still exceeds selected tube current at this lower filament current. If the tube current still exceeds selected tube current at this lower filament current, a filament current decreasing means or step 110 causes the filament current to be decreased by the smaller step and if the tube current is less than selected at this filament current, a filament current increasing means or step 112 causes the filament current to be increased by the half step. A step reducing means or step 114 divides the filament current step in half again. This process of adjusting the filament current, starting an exposure to see if the tube current exceeds the selected current, and dividing the filament step by two continues until a step or means 116 determines that a preselected minimum filament current step size has been reached. The filament current at this point is then designated as the calibrated filament current at the selected kV and mA.

When the minimum step value determining means 116 determines that the best possible calibration has been attained, a recording means 118 records the filament current for the selected tube voltage and tube current combination in an appropriate memory cell 120 of a tube current memory 122 (FIG. 1). A tube voltage decrementing means or step 124 decrements the tube voltage to a lower one of the selected tube voltages, e.g. 126. The filament current is again incremented and zeroed in on the appropriate tube filament current to attain the first selected tube current at this lower selected tube voltage which filament current is recorded in an appropriate memory cell 128 with the filament current memory means 122.

This process is repeated until a tube voltage minimum determining means 130 that determines that the minimum selectable tube voltage has been reached. When the minimum tube voltage is reached, a step or means 132 resets the filament current to the previously calibrated filament current at the maximum kV, i.e. point 90. The tube current incrementing step or means 94 increments the tube current and resets the tube voltage value to the maximum value. Thus, the first exposure at this new mA-kV combination is guaranteed not to exceed anode loading limit. The tube current calibration process is repeated until the appropriate filament current is determined to achieve the next selected calibration point 134 and each of a selected plurality of successive tube voltage, tube current combinations are obtained.

Although every selectable tube current, tube voltage combination might be selected and calibrated individually, it is preferred that only a fraction of the tube current, tube voltage combinations are actually calibrated and that the rest are determined by interpolation. To this end, an interpolating means or step 140 interpolates the actually calibrated tube currents (denoted by a solid circle in FIG. 2 and an x in memory 122 of FIG. 1) to determine appropriate tube currents for each selectable tube current, tube voltage combination.

It is to be appreciated that once the emission current level is determined, the selected tube current, tube voltage combinations can be calibrated in various orders. Preferably, the calibration is conducted from the minimum tube current towards the maximum tube current.

Once the current filament look-up table 122 has been filled, the x-ray tube is calibrated and ready to be operated. An operator keyboard 142 has appropriate input buttons or dials for the operator to select any one of the selectable x-ray tube voltage and current combinations. The microprocessor means 50 addresses the current filament look-up table 112 with the selected tube voltage and current and retrieves the corresponding filament current. The microprocessor then controls the current filament control means 16 to provide the retrieved filament current and controls the tube voltage control means 22 to provide the selected tube voltage for a selected exposure duration.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A method of calibrating an x-ray tube filament emission point, the method comprising:

(a) applying a small filament current to a cathode filament of the x-ray tube, which small filament current is too small to cause a tube current between the cathode filament and an anode of the x-ray tube at a selected maximum tube voltage;

(b) applying the selected maximum tube voltage across the cathode filament and the anode of the x-ray tube;

(c) while the selected maximum tube voltage is being applied, monitoring for the tube current between the cathode filament and the anode; and, (d) increasing the filament current and repeating steps (a)–(c) until the tube current is first monitored.

2. A method of calibrating x-ray tube filament currents based on first determining a filament emission point, the method comprising:

(a) applying a small current to a cathode filament of the x-ray tube, which small current is too small to cause a tube current between the cathode filament and an anode of the x-ray tube at a selected maximum tube voltage;

(b) applying a first selected tube voltage across the cathode and an anode of the x-ray tube;

(c) while the first selected tube voltage is being applied, monitoring for an x-ray emission point;

(d) adjusting the cathode filament current until the filament emission point is monitored;

(e) decrementing the tube voltage to a second tube voltage;

(f) increasing the filament current from the filament current at which the filament emission point was first monitored;

(g) monitoring the resultant tube current;

(h) comparing the monitored tube current with a selected tube current;

(i) repeating steps (f)–(h) until the selected tube current is achieved;

(j) storing the filament current at which the selected tube current is achieved in a filament current memory means in a memory cell that is addressable by tube voltage and tube current.

3. The method as set forth in claim 2 further including:

(k) incrementing the selected tube current and returning to the first selected tube voltage and repeating steps (f)-(j), whereby anode overloading is avoided by basing each tube current/tube voltage calibration on previously calibrated values.

4. A method of calibrating x-ray tube filament currents based on first determining a filament emission point, the method comprising:

(a) applying a small current to a cathode filament of the x-ray tube, which small current is too small to cause a tube current between the cathode filament and an anode of the x-ray tube at a selected maximum tube voltage;

(b) applying a selected tube voltage across the cathode and an anode of the x-ray tube;

(c) while the selected voltage is being applied, monitoring for an x-ray emission point;

(d) adjusting the cathode filament current until the filament emission point is monitored;

(e) increasing the filament current and monitoring the resultant tube current;

(f) comparing the monitored tube current with a selected tube current;

(g) repeating steps (e) and (g) until the selected tube current is achieved;

(h) incrementing the selected tube current and repeating steps (e) through (g);

(i) storing the filament current at which each selected tube current is achieved in a filament current memory means in a memory cell that is addressable by tube voltage and tube current.

5. The method as set forth in claim 4 further including:

(j) decrementing the selected tube voltage to a lower selected tube voltage and repeating steps (e)-(g).

6. A method of calibrating x-ray tube filament currents based on first determining a filament emission point, the method comprising:

(a) applying a small current to a cathode filament of the x-ray tube, which small current is too small to cause a tube current between the cathode filament and an anode of the x-ray tube at a selected maximum tube voltage;

(b) applying the selected tube voltage across the cathode and an anode of the x-ray tube;

(c) while the selected tube voltage is being applied, increasing the filament current in steps of a first magnitude;

(d) monitoring for a tube current and repeating step (c) until the tube current is first monitored;

(e) after the tube current is first monitored, decrementing the filament current by half a step, if the tube current is still detected, decrementing the filament current by a quarter step and if the tube current is no longer detected, incrementing the tube current by the quarter step.

7. A method of calibrating x-ray tube filament currents, the method comprising:

(a) applying a selected tube voltage;

(b) increasing a filament current from a filament emission current at which the filament emission point was first monitored in steps of a first magnitude;

(c) monitoring the resultant tube current;

(d) comparing the monitored tube current with a preselected tube current;

(e) repeating steps (a)-(d) until the selected tube current is achieved;

(f) after the monitored tube current exceeds the preselected tube current, decrementing the filament current by half a step, if the tube current still exceeds the preselected tube current, decrementing the filament current by a quarter step and if the tube current is below the preselected tube current, incrementing the tube current by the quarter step.

8. The method as set forth in claim 7 further including decrementing the tube voltage and repeating steps (b)-(f).

9. The method as set forth in claim 7 further including incrementing the preselected tube current and repeating steps (b)-(f).

10. A method of calibrating pairs of x-ray tube filament current and tube voltage values, the method comprising:

applying a filament current and tube voltage at a first previously calibrated pair of filament current and tube voltage values to an x-ray tube to generate a first tube current;

decrementing the tube voltage to a second selected tube voltage value;

progressively increasing the filament current until the generated tube current again reaches the first tube current;

recording the filament current and tube voltage values at which the first tube current is again reached;

repeating the tube voltage decrementing and filament current progressively increasing steps for each of a plurality of filament current and voltage pairs, whereby anode overloading is prevented by basing each calibration on previously calibrated values.

11. An x-ray tube system comprising:

an x-ray tube having an anode, a cathode filament, and a power supply means for selectively applying a voltage across the anode and cathode filament;

cathode filament control means for controlling a current applied through the cathode filament;

a tube current monitoring means for monitoring a tube current flow between the cathode filament and the anode;

a calibration means including:

a means for causing the cathode filament control means to apply current to the cathode filament of the x-ray tube;

a means for causing the x-ray tube voltage control means to apply a selected voltage across the cathode filament and the anode;

a means for causing the tube current monitoring means to determine whether the x-ray tube current flow between the cathode filament and the anode while the preselected voltage is being applied;

a means for causing the cathode filament control means to increase the filament current in preselected current steps;

a means for decreasing the filament current in the preselected current steps; and a means for reducing the preselected current steps.

12. The x-ray tube system as set forth in claim 11 wherein the calibration means further includes:

a means for comparing the monitored tube current with a preselected tube current.

13. The x-ray tube system as set forth in claim 12 further including:

a filament current memory means for storing each filament current at which the selected tube current is monitored, the filament current memory means being addressable by each of a plurality of preselected tube voltage and tube current.

14. The x-ray system as set forth in claim 12 wherein the means for causing the cathode filament control means to increase the filament current increases the filament current in preselected current steps and wherein the calibration means further includes:

a means for decreasing the filament current in the preselected current steps, and a means for reducing the preselected current steps.

15. A method of calibrating pairs of x-ray tube filament current and tube voltage values, the method comprising:

applying a filament current and tube voltage at a first previously calibrated pair of filament current and tube voltage values to an x-ray tube to produce a first tube current;

selecting a second tube current higher than the first tube current;

progressively increasing the filament current until the tube current reaches the second selected tube current;

recording the filament current and tube voltage values at which the second selected tube current was reached;

repeating the selected tube current incrementing and filament current increasing steps for each of a plurality of selected tube currents to determine a plurality of corresponding filament current and voltage pairs, whereby anode overloading is prevented by basing each calibration on previously calibrated values.

* * * * *